US005463368A

United States Patent [19]

Tsunoda et al.

[11] Patent Number: 5,463,368

[45] Date of Patent: Oct. 31, 1995

[54] METHOD OF SETTING AN INAUDIBLE ALERT MODE IN A RADIO PAGER

[75] Inventors: Kazuyuki Tsunoda; Ichiro Fujisawa, both of Tokyo, Japan

[73] Assignees: NEC Corporation; NTT Mobile Communication Network, Inc., both of Tokyo, Japan

[21] Appl. No.: 162,285

[22] Filed: Dec. 7, 1993

[30] Foreign Application Priority Data

Dec. 8, 1992 [JP] Japan ..... 4-327107

[51] Int. Cl.[6] ..... G08B 1/00

[52] U.S. Cl. ..... 340/309.15; 340/825.44; 340/825.48; 340/311.1

[58] Field of Search ..... 340/311.1, 825.44, 340/825.45, 825.46, 825.47, 825.48

[56] References Cited

U.S. PATENT DOCUMENTS 4,894,649 1/1990 Davis ..... 340/825.44

*Primary Examiner*—Brent Swarthout
*Assistant Examiner*—Daryl C. Pope
*Attorney, Agent, or Firm*—Sughrue, Mion, Zinn, Macpeak & Seas

[57] ABSTRACT

In order to change a subscriber alert mode of a radio pager from an audible alert mode to an inaudible alert mode, a normally open function switch is depressed while the radio pager operates in the audible alert mode. The function switch is subsequently depressed. Following this, a timer is set to count up to a predetermined time period. A pager display exhibits a silent time duration for which the pager will operate in the inaudible alert mode if the timer counts up the predetermined time period. Subsequently, another timer is set to count up to a predetermined time period if the function switch is released. Thereafter, if the second timer counts up the second predetermined time period and if the function switch remains released, the radio pager is set to operate in the inaudible alert mode for the set silent time duration.

18 Claims, 5 Drawing Sheets

B
ERASE DISPLAY
70
TIMER 2 RESET & SET
72
T2 ELAPSES
74
NO
FUNCTION SW 46 RELEASED
NO
YES
76
YES
A
DISPLAY TS
78
80
FUNCTION SW 46 RELEASED
NO
YES
TIMER 3 RESET & SET
82
BEEP ONCE
84
T3 ELAPSES
NO
FUNCTION SW 46 DEPRESSED
NO
86
YES
88
YES
C
D
90
BEEP THREE TIMES
92
SET SILENT MODE
F
WAIT IN SILENT MODE
94
YES
E
FUNCTION SW 46 DEPRESSED
96
NO
98
TS ELAPSES
NO
G
YES
BEEP THREE TIMES
100
SET AUDIBLE ALERT MODE
102
A

METHOD OF SETTING AN INAUDIBLE ALERT MODE IN A RADIO PAGER

BACKGROUND OF THE INVENTION

1. Field of the Invention

The present invention relates generally to a method of setting an alert mode of a radio pager for effectively expanding usage or utility thereof, and more specifically to a method of changing a pager alert mode from a normal audible alert to an inaudible alert. A pager subscriber is permitted to reset the inaudible alert mode when desired and induce the pager to again operate in the normal audible mode.

2. Description of Related Art

It is well known in the art that a radio pager is provided with two subscriber alert modes: one is an audible mode using a speaker and the other is an inaudible or muting mode using a light source and/or a vibrator.

In order to prevent a subscriber from missing a call, it is a current practice to normally operate the pager in an audible alert mode wherein a speaker is energized so as to audibly alert the subscriber. However, it is often the case that a subscriber wishes to be alerted without the use of audible means in such environments as during business and private meetings, in theaters, etc.

In order to meet such practical requirements, it has been proposed that a subscriber be able to change the audible alert mode to an inaudible one using a function switch provided in a pager.

However, a conventional pager is such that once a subscriber sets it to an inaudible alert mode, the pager indefinitely remains set in the inaudible mode until the subscriber restores the audible alert mode. Accordingly, the conventional pager has encountered the drawback that a subscriber sometimes fails to detect a call because he or she has forgotten to change the inaudible alert mode back to the normal audible alert mode after attending the theater or the like (for example).

SUMMARY OF THE INVENTION

It is therefore an object of the present invention to provide a method of enabling a normal audible alert mode to be temporarily changed to an inaudible alert mode for a predetermined time period.

Another object of the present invention is to provide a method of enabling an inaudible alert mode to be set for a predetermined time period selected by a pager subscriber.

Still another object of the present invention is to provide a method of enabling an audible alert mode to be restored when a subscriber wishes to terminate an inaudible alert mode which has been set to a predetermined time period or to continue indefinitely.

In brief, the above objects are achieved by a method wherein, in order to change a subscriber alert mode of a radio pager from an audible alert mode to an inaudible alert mode, a normally open function switch is depressed while the radio pager operates in the audible alert mode. The function switch is subsequently depressed. Following this, a timer is induced to count over a predetermined time period. A pager display exhibits the silent time duration for which the pager is to operate in the inaudible alert mode if the timer counts up to the predetermined time period. Subsequently, another timer is used to count over a predetermined time period if the function switch is released. Thereafter, if the second timer counts up to the second predetermined time period and if the function switch remains released, the radio pager is set so as to operate in the inaudible alert mode for the set silent time duration.

BRIEF DESCRIPTION OF THE DRAWINGS

The features and advantages of the present invention will become more clearly appreciated from the following description taken in conjunction with the accompanying drawings in which.

DETAILED DESCRIPTION OF THE PREFERRED EMBODIMENTS

Figure 1:
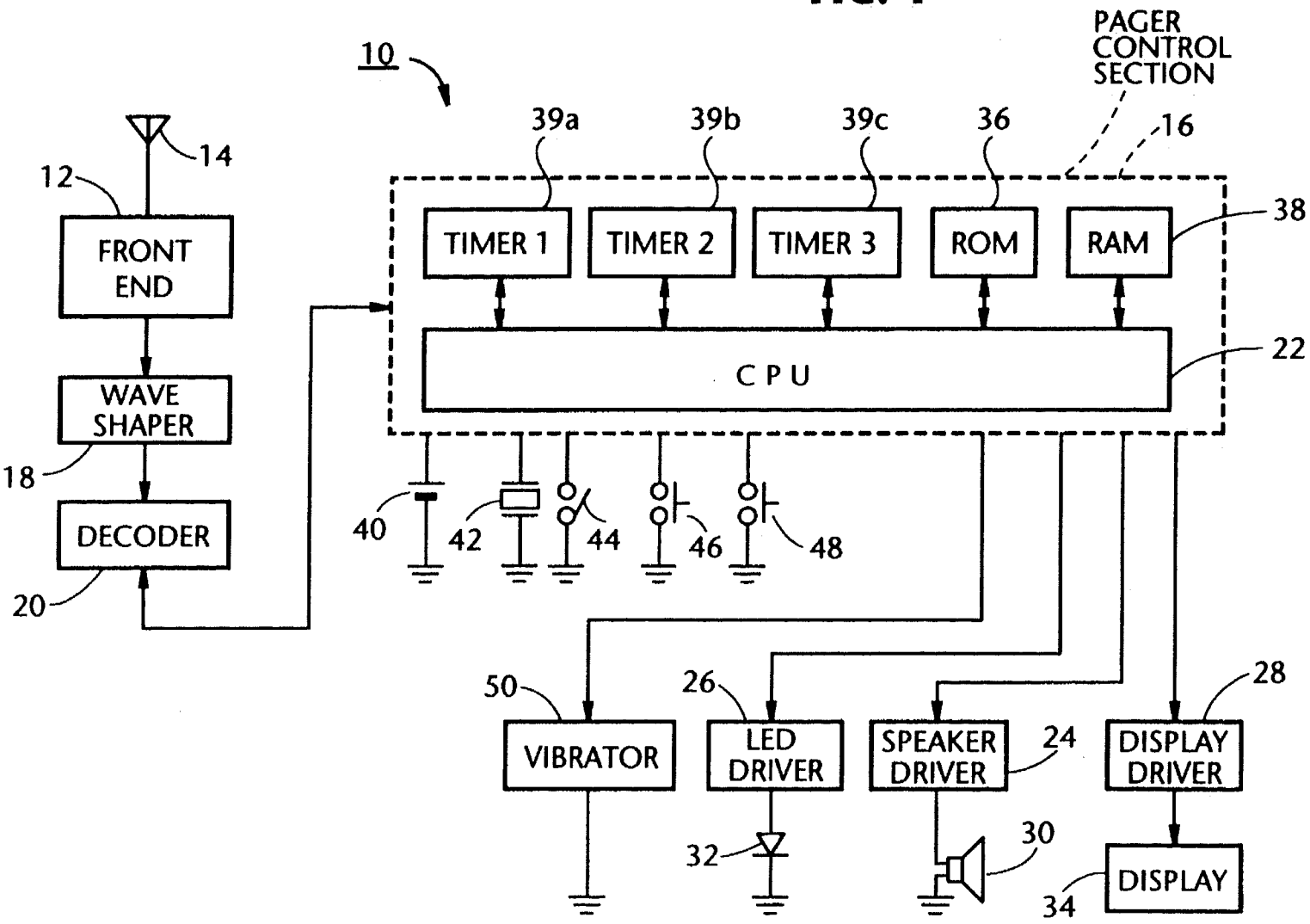
FIG. 1 is a block diagram showing an arrangement of a radio pager to which the present invention is applicable.

FIG. 1 shows schematically an arrangement of a battery operated radio pager 10 to which the present invention is applicable.

As shown, a front end 12 is provided for amplifying and demodulating a code-modulated carrier wave received by an antenna 14. The front end 12 is a conventional circuit arrangement comprised of a high frequency amplifier, a frequency converter, an IF (Intermediate Frequency) amplifier, and a discriminator. Although not shown in FIG. 1, the front end 12 is usually periodically energized by a plurality of preamble search pulses which are applied from a controller 16. However, as the present invention is not directly concerned with battery saving and hence further description thereof will be omitted for brevity.

It is assumed that the front end 12 acquires one of the preambles sequentially transmitted from a calling station (not shown). The output of the front end 12 is applied, after being wave-shaped at a wave shaper 18, to a decoder 20. The decoder 20 searches for a preamble and a synchronization codeword preceded thereby. If the codeword is detected, the decoder 20 searches for an identifying address code by comparing the same with a subscriber's unique code prestored in a ROM (Read Only Memory) (not shown in FIG. 1) within the decoder 20.

In the event that the identifying address code coincides with the subscriber's unique code, the decoder 20 activates the control section 16 and the applies message data included in the following batches to the control section 16. When the control section 16 acquires the message data, a CPU (Central Processing Unit) 22 activates a speaker driver 24 and a LED (Light Emitting Diode) driver 26 in an audible alert mode. Thus, both a speaker 30 and a light source (viz., LED) 32 are energized for alerting the subscriber in the audible alert mode. Further, the message directed to the subscriber is demonstrated on a display 34 via a display driver 28.

A ROM 36 is provided for storing a program which controls the overall operations of the pager 10, while a RAM (Random Access Memory) 38 is used to define a work space needed for pager operations. As shown, the pager control section 16 includes three timers 39*a*–39*c* (also denoted by TIMER 1, TIMER 2 and TIMER 3) which are directly concerned with the present invention. Further, the control section 16 is operatively coupled to a battery 40, an oscillator 42, a pager power switch 44, a normally open function switch 46, a normally open memory switch 48, and a vibrator 50.

As referred to in the above, the control section 16 energizes the speaker 30 and the LED 32 in the audible alert mode. On the other hand, the control section 16 energizes the vibrator 50 and the LED 32 in an inaudible alert mode.

Although the vibrator 50 is shown in FIG. 1, it is often the case that the vibrator 50 is omitted in a usual pager. In such a case, it goes without saying that only the LED 32 is energized in the inaudible alert mode.

FIGS. 2–5 each is a flow chart which shows the steps which characterize the operations of the present invention. Merely for the convenience for clearly distinguishing between audible and inaudible alert modes, the inaudible alert mode will be referred to as the SILENT MODE in the following discussion.

It is assumed that: (a) a plurality of messages can be stored in the RAM 38, and (b) TIMERs 1–3 respectively count up 30 seconds (T1), 2 second (T2), and 3 seconds (T3) after rendered operative.

Figure 2:
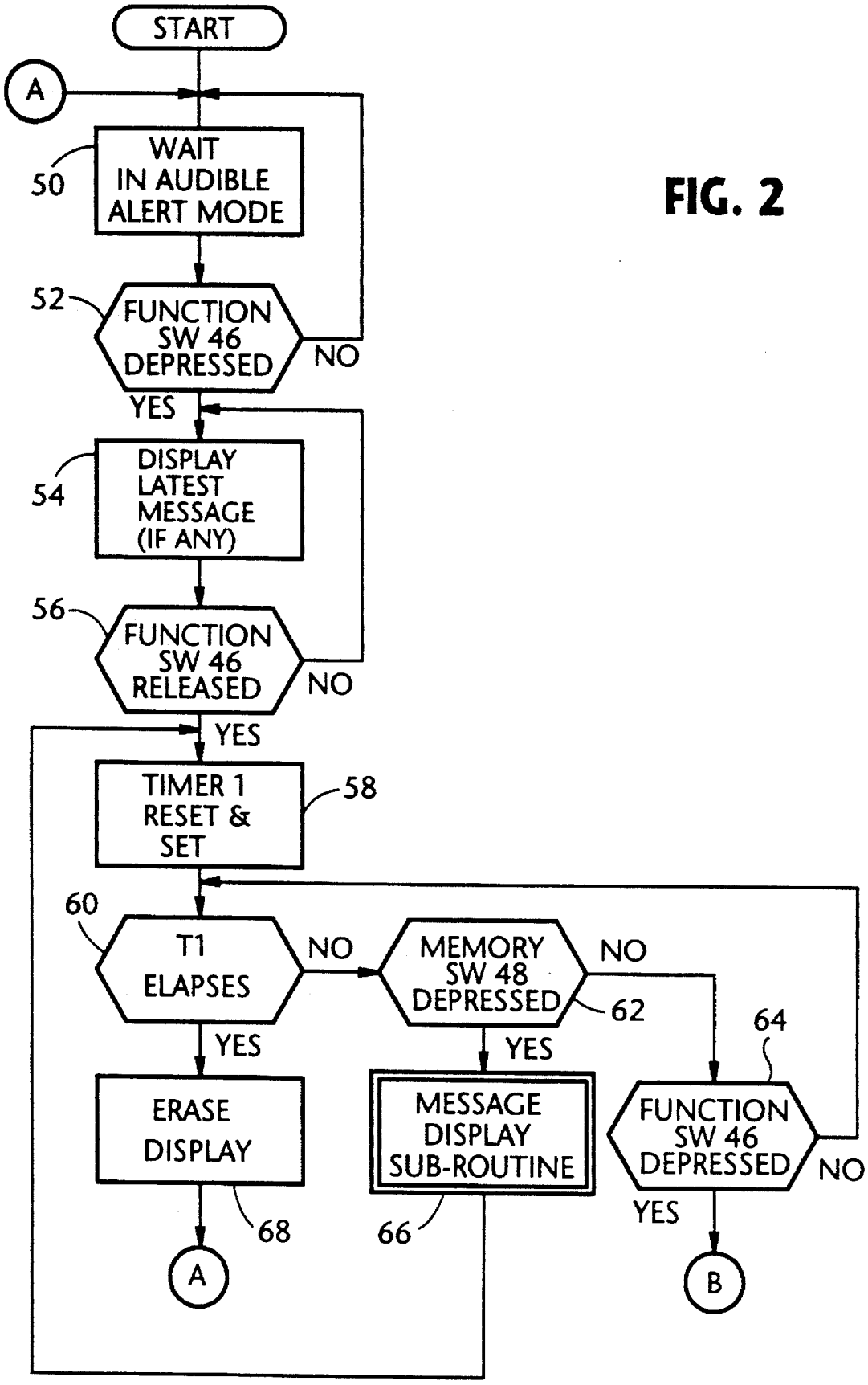
FIGS. 2–5 each is a flow chart which shows the steps which characterize the operations of the present invention.

In FIG. 2, at step 50, the pager 10 is in an audible alert mode and waits for an incoming signal directed thereto until the function switch 46 is depressed (step 52). In the event that the function switch 46 is depressed (step 52), the latest message stored in the RAM 38 (if any) is displayed on the display 34 at step 54. Following this, a check is made to see if the function switch 46 is released at step 56. It is understood that the latest message remains exhibited on the display 34 as long as the function switch 46 is depressed (steps 54 and 56). If the function switch 46 is released at step 56, TIMER 1 is reset and immediately thereafter rendered operative at step 58.

Let us consider the situation wherein the routine enters a loop of steps 60, 62 and 64. That is, TIMER 1 does not count up to the time period T1 (viz., 30 seconds) and the switches 46 and 48 are not depressed. In this case, if the memory switch 48 is depressed at step 62, the program proceeds to a message display sub-routine 66 wherein the second latest message stored in the RAM 38 (if any) is exhibited on the display 34. Subsequently, the program goes back to step 58 wherein TIMER 1 is again reset and immediately thereafter rendered operative (viz., set).

The sub-routine 66, upon the memory switch 48 being depressed, counts the number of depressing operations of the switch 48 and displays the message stored in the RAM 38 depending on the number of depressions. If all the messages stored in the RAM 38 have been displayed, a suitable message indicative of no remaining message is exhibited on the display 34 in response to the depression of the function switch 46. The operations of the sub-routine 66 is irrelevant to the instant invention and hence further descriptions thereof will be omitted for simplifying the disclosure.

If the time period T1 (30 seconds) elapsed at step 60, the message on the display 34 is erased at step 68 and the routine returns to step 50.

Figure 3:
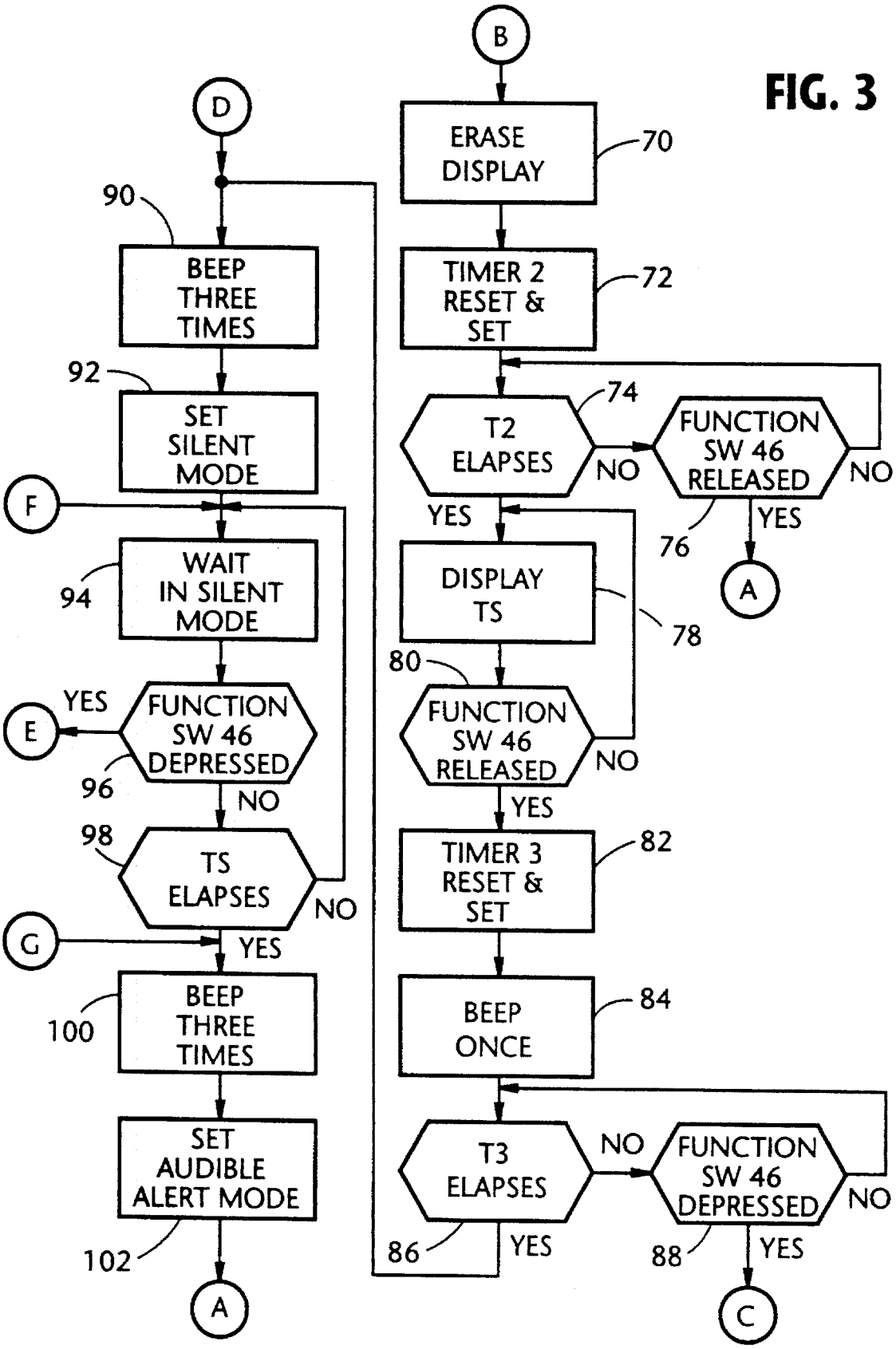

On the other hand, before T1 elapses (step 60), if the function switch 46 is depressed at step 64, the program proceeds to step 70 (FIG. 3).

In FIG. 3, the display 34 is cleared at step 70 after which TIMER 2 is reset and immediately thereafter rendered operative (step 72). If the function switch 46 is depressed at step 76 before the time period T2 (2 seconds) elapses, the routine goes back to step 50 (FIG. 2). Thus, the pager 10 waits for an incoming signal in the audible alert mode.

If the outcome of the inquiry performed at step 74 is "yes" (viz., if T2 has elapsed), a time period currently set for the SILENT MODE (denoted by TS) is demonstrated on the display 34. The time period TS presently displayed, is a default value (10 minutes) or a time period which has been set in the previous SILENT MODE. At step 80, a check is made to see if the function switch 46 is released. If the switch 46 remains depressed (viz., the answer is NO), the display of TS continues (steps 78 and 80). Otherwise (viz., if the function switch 46 is released at step 80), TIMER 3 is reset (cleared) and immediately thereafter is set (set counting) at step 82. Subsequently, a single short sound is generated at step 84, after which a check is made to see if T3 (3 seconds) has elapsed at step 86. If TIMER 3 is detected as having counted up to T3 at step 86, the speaker 30 is energized to beep three times at step 90 to alert the subscriber that the pager 10 is entering into the SILENT MODE. Subsequently, the pager 10 is set to SILENT MODE at step 92 and thus, waits for an incoming signal.

Figure 5:
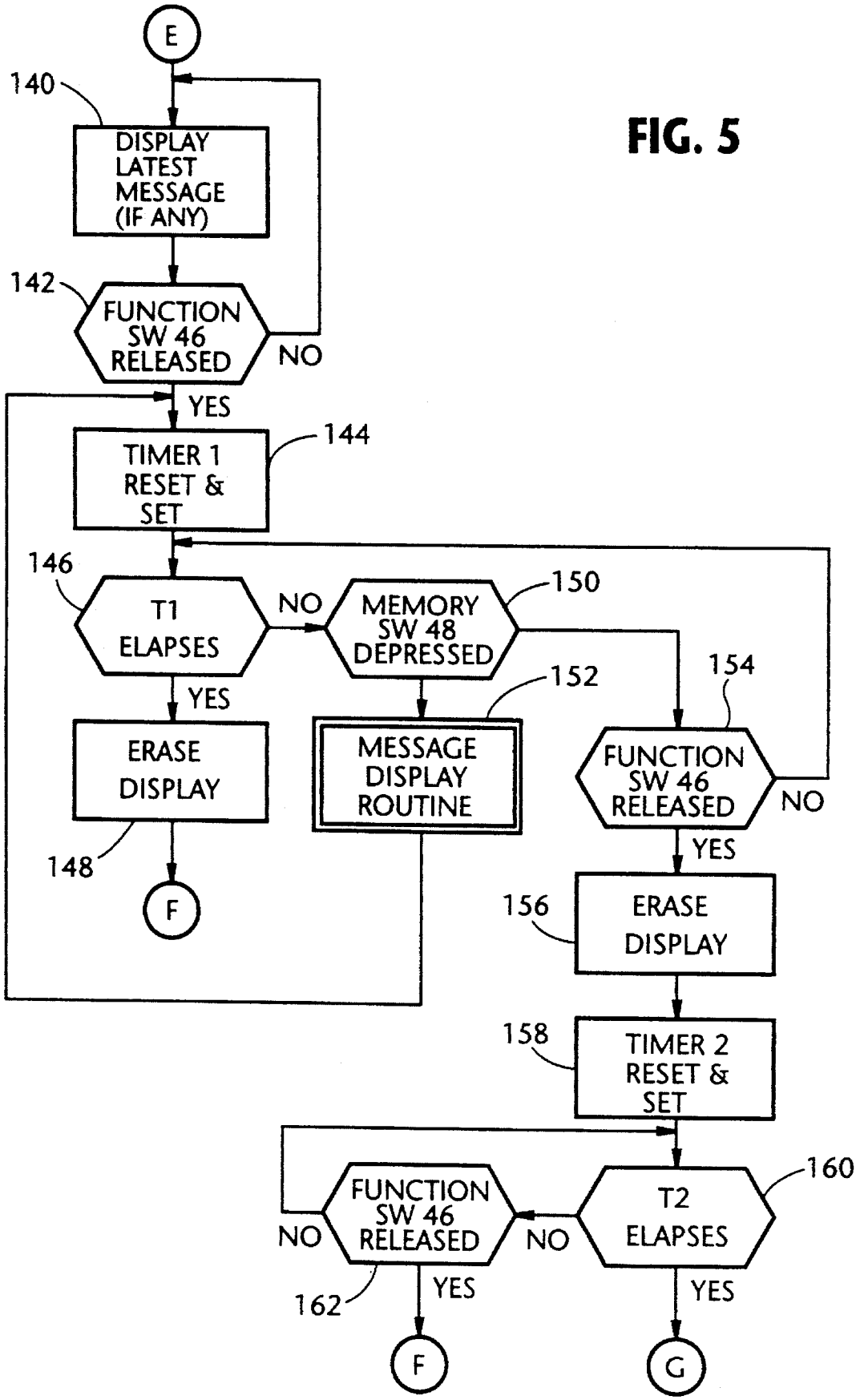

While the pager 10 operates in the SILENT MODE, two checks are repeatedly made at steps 96 and 98. If the function switch 46 is depressed at step 96, the routine goes to step 140 (FIG. 5). On the other hand, if the time period TS elapses at step 98, the speaker 30 beeps three times at step 100 after which the pager 10 is set to the audible alert mode at step 102. Following this, the routine goes to step 50 wherein the pager 10 waits for an incoming signal in the audible mode in the manner described above.

Turning to step 88, if the function switch 46 is depressed, step 110 (FIG. 4) is implemented.

Figure 4:
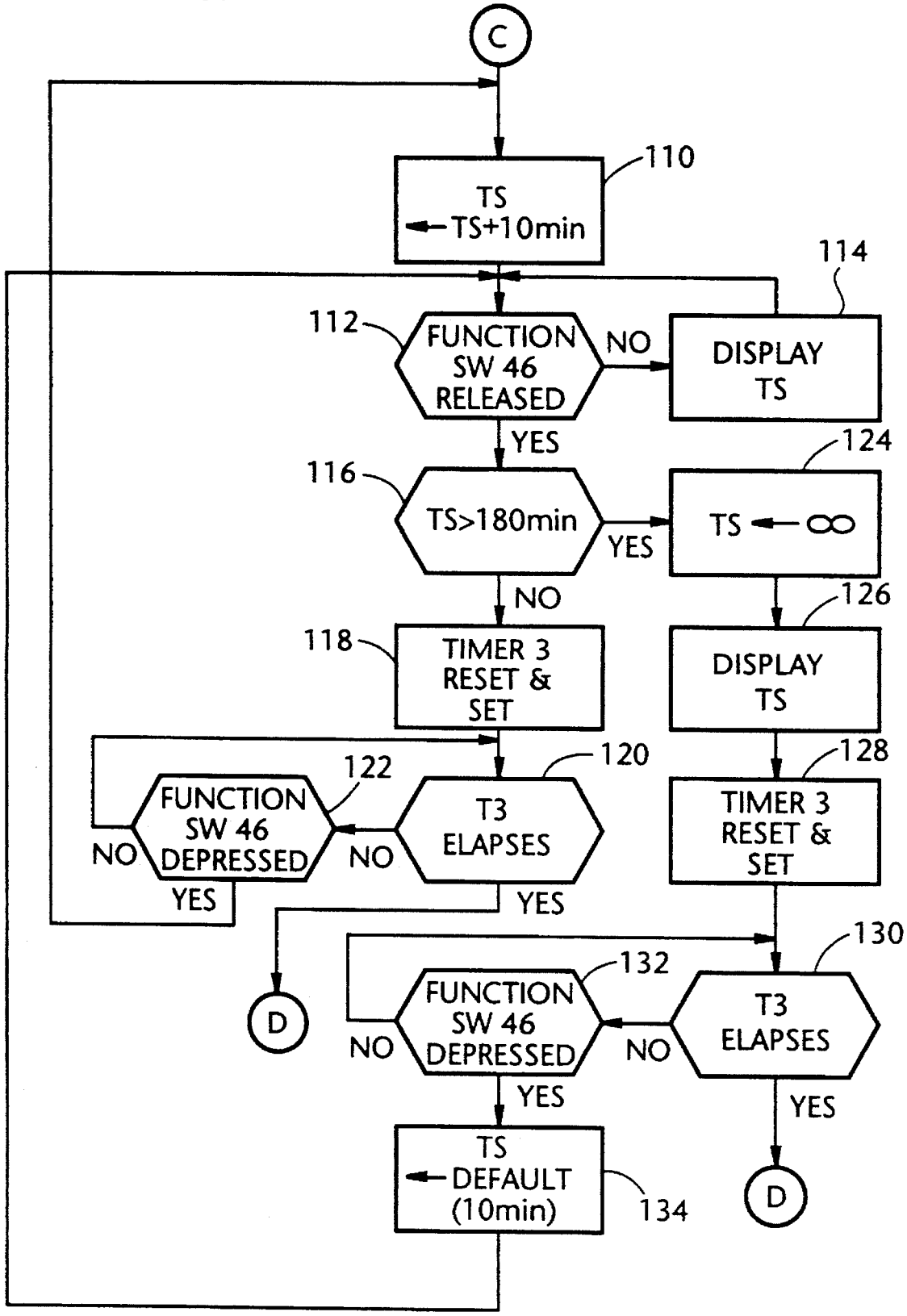

FIG. 4 is a flow chart which shows the steps which characterize the operations for selecting the time period TS for which the pager 10 operates in the SILENT MODE. In the instant embodiment, the time period TS is incremented by 10 minutes (for example) each time the function switch 46 is depressed. After the time period TS is increased to a maximum value (180 minutes for example) through repeated depressions of the function switch 46, TS returns to 10 minutes (default value) upon one further depression of the switch 46. Following this, TS is again incremented by 10 minutes each time the function switch 46 is depressed.

As shown in FIG. 4, the time period TS is incremented by 10 minutes at step 110, after which the function switch 46 is checked to see if it has been released (step 112). It is understood that the time period TS continues to be displayed until the function switch 46 is released (steps 112 and 114). At step 112, if the outcome is positive (viz., the switch 46 is released), the time period TS is checked to see if it exceeds 180 minutes (viz., the maximum value). If TS has not reached 180 minutes, TIMER 3 is reset and immediately thereafter rendered operative at step 118. Subsequently, TIMER 3 is checked to see if T3 has elapsed. If the outcome is NO at step 120, the function switch 46 is checked to see if it is depressed (step 122). If TIMER 3 counts up to T3 (step 120) while the program circles through a loop of steps 120 and 122, the program goes to step 90 (FIG. 3) wherein the speaker 30 beeps three times for alerting the subscriber that the SILENT MODE is to be entered.

On the other hand, if the function switch 46 is depressed at step 122, the routine goes back to step 110 wherein TS is further incremented by 10 minutes. From the foregoing, it is understood that the time period TS is incremented in a step-by-step manner (viz., by 10 minutes) up to 180 minutes by depressing the function switch 46 (steps 112, 116, 118, 120, 122 and 110).

If the time period TS exceeds 180 minutes at step 116, the routine proceeds to step 124 wherein an unlimited or infinite time period is set as TS. At step 126, this unlimited time period TS is displayed, using the words "SILENT MODE FIXED" or "SILENT MODE" plus an infinite symbol ∞ (for example), on the display 34. At step 128, TIMER 3 is reset and immediately thereafter rendered operative. Following this, at step 130, TIMER 3 is checked if it has counted up to TS. Before TIMER 3 counts up T3, if the function switch 46 is depressed (step 132), the default value of TS (viz., 10 minutes) is set to TS at step 134 after which the routine goes back to step 112. Otherwise (viz., TIMER 3 has counted up to T3 at step 130), the program goes to step 90 wherein the speaker 30 beeps three times for alerting the subscriber that the pager 10 is entering the SILENT MODE. In this case, the pager 10 is indefinitely fixed in the SILENT MODE and thus does not restore automatically the audible alert mode.

FIG. 5 is a flow chart which shows the steps which characterize the operations wherein the SILENT MODE is manually rendered to the audible alert mode.

As mentioned above, if the function switch 46 is depressed at step 96 (FIG. 3) while the pager 10 operates in SILENT MODE, the routine proceeds to step 140 (FIG. 5).

In FIG. 5, the latest message acquired in the SILENT MODE and stored in the RAM 38 (if any), is displayed on the display 34 at step 140. Following this, at step 142, a check is made if the function switch 46 is released. The latest message remains exhibited on the display 34 as long as the function switch 46 remains depressed (steps 140 and 142). At step 142, if the function switch 46 is released, TIMER 1 is reset and immediately thereafter rendered operative at step 144.

Subsequently, TIMER 1 is checked to see if it has counted up to T1 (step 146). If T1 (viz., 30 seconds) has not elapsed, the memory switch 48 is checked to determine if it is depressed (step 150). Further, the function switch 46 is checked to see if it is depressed (step 154). If the memory switch 48 is depressed at step 150, the program proceeds to a message display sub-routine 152 wherein the second latest message stored in the RAM 38 (if any) is exhibited on the display 34. Subsequently, the program goes back to step 144 wherein TIMER 1 is again reset and immediately thereafter rendered operative (viz., set).

The sub-routine 152 is identical to the above-mentioned sub-routine 66 and hence further descriptions thereof will be omitted for brevity.

At step 146, if the time period T1 (viz., 30 seconds) has elapsed, the message on the display 34 is erased at step 148 and the routine returns to step 94 (FIG. 3). In this instance, the pager 10 remains in the SILENT MODE.

By contrast, if the function switch 46 is depressed at step 154, the display 34 is cleared at step 156. Further, TIMER 2 is reset and immediately thereafter rendered operative at step 158. If the function switch 46 is released at step 162 before the time period T2 (2 seconds) elapses, the routine goes back to step 94 (FIG. 3). In this instance, the pager 10 remains in the SILENT MODE. By contrast, if TIMER 2 counts up to T2 at step 160, the routine goes to step 100 wherein the pager 10 energizes the speaker 30 to beep three times and enters the audible alert mode.

In the above discussion, the three timers 39*a*–39*c* (viz., TIMERs 1–3) are provided. However, one of TIMERs 2 and 3 can be omitted. Further, it is preferable to provide, between steps 116 and 118 of FIG. 4, a step or steps for displaying TS.

It will be understood that the above disclosure is representative of only one possible embodiment and that various modifications can be made without departing from the concept of the instant invention.

What is claimed is:

1. A method of changing a subscriber alert mode of a radio pager having a display from an audible alert mode to an inaudible alert mode using a normally open function switch provided in said pager, said method comprising the steps of:

(a) depressing said function switch while said radio pager operates in said audible alert mode;

(b) subsequently depressing and holding said function switch;

(c) inducing a first timer to count a first predetermined time period while said function switch remains depressed;

(d) displaying, on said display, a silent time duration, for which said radio pager will operate in said inaudible alert mode, when said first timer finishes counting up said first predetermined time period;

(e) inducing a second timer to count a second predetermined time period when said function switch is released; and (f) setting said radio pager to operate in said inaudible alert mode for said silent time duration when said second timer finishes counting up to said second predetermined time period when said function switch remains released.

2. A method as claimed in claim 1, wherein said first and second predetermined time periods are equal to each other.

3. A method as claimed in claim 1, wherein when said second timer is counting said second predetermined time period and said function switch is depressed at step (f), said method further comprises the steps of:

(g) incrementing said silent time duration by a predetermined time duration;

(h) inducing said second timer to count said second predetermined time period when said function switch is released; and (i) setting said radio pager so as to operate in said inaudible alert mode for said silent time duration which has been incremented at step (g), when said second timer finishes counting up to said predetermined time period.

4. A method as claimed in claim 3, wherein when said second timer is counting said second predetermined time period at step (i), said method further comprises the steps of:

(j) incrementing said silent time duration by said predetermined time duration when said function switch is depressed;

(k) inducing said second timer to count said second predetermined time period when said function switch is released;

(l) setting said radio pager to operate in said inaudible alert mode for said silent time duration which has been incremented at step (j), when said function switch remains released and second timer finishes counting up said second predetermined time period; and (m) returning to step (j) when said second timer is counting and said function switch is depressed.

5. A method as claimed in claim 4, wherein when said silent time duration, which has been incremented at step (j), exceeds a maximum allowable value, said method further comprises the steps of:

(n) setting said silent time duration to an unlimited time duration;

(o) inducing said second timer to count said second predetermined time period; and (p) setting said radio pager to operate in said inaudible alert mode for an unlimited time period mode when said second timer finishes counting up said second predetermined time period, as long as said function switch remains released.

6. A method as claimed in claim 5, wherein when said second timer is counting at step (p), said method further comprises the steps of:

(q) setting said silent time duration to a default value when said function switch is depressed;

(r) inducing said second timer to count said second predetermined time period when said function switch is released; and (s) setting said radio pager to operate in said inaudible alert mode for said silent time duration which has been set at step (q), when said function switch remains released and said second timer finishes counting up to said second predetermined time period.

7. A method as claimed in claim 6, wherein when said second timer is counting said second predetermined time period at step (s), said method further comprises the steps of:

(t) incrementing said silent time duration by said predetermined time duration when said function switch is depressed;

(u) setting said second timer for counting said second predetermined time period when said function switch is released; and (v) setting said radio pager in said inaudible alert mode for said silent time duration which has been incremented at step (t), when said function switch remains released and said second timer finishes counting up said second predetermined time period; and (w) returning to step (t) when said second timer is counting and said function switch is depressed.

8. A method as claimed in claim 1, further comprising the step of:

after step (a) and before step (b), inducing a third timer to count a third predetermined time period; and wherein step (c) is performed when step (b) is performed before said third timer finishes counting up said third predetermined time period.

9. A method as claimed in claim 1, wherein step (d) displays said silent time duration when said first timer finishes counting up said first predetermined time period and said function switch, which was depressed in step (b), is still depressed.

10. A method as claimed in claim 1, further comprising the step of causing said radio pager to emit an audible sound after step (e) is performed.

11. A method as claimed in claim 1, wherein step (f) comprises the step of causing said radio pager to emit an at least one audible sound before setting said radio pager to said inaudible alert mode.

12. A communication apparatus having a display and functioning in an audible alert mode and an inaudible alert mode, comprising:

a function switch for switching said communication device from said audible alert mode to said inaudible alert mode and vice versa;

a first timer which counts a first predetermined time period after said function switch is depressed;

a display device, which displays, on said display, a silent time duration, for which said communication device will operate in said inaudible alert mode, when said first timer finishes counting up said first predetermined time period while said function switch remains depressed;

a second timer which counts a second predetermined time period when said function switch is released; and a control device which sets said communication device to operate in said inaudible alert mode for said silent time duration when said second timer finishes counting up to said second predetermined time period when said function switch remains released.

13. A communication apparatus as claimed in claim 12, wherein said first and second predetermined time periods are equal.

14. A communication apparatus as claimed in claim 12, wherein said control device further performs the following functions:

when said second timer is counting said second predetermined time period and said function switch is depressed, increments said silent time duration by a predetermined time duration; and induces said second timer to count again said second predetermined time period when said function switch is released after said silent time duration has been incremented; and wherein said setting device sets said radio pager so as to operate in said inaudible alert mode for said silent time duration which has been incremented when said second timer, induced to count again by said device, finishes counting up to said predetermined time period.

15. A communication apparatus as claimed in claim 14, wherein said control device further performs the following functions:

when said second timer is again counting said second predetermined time period as induced by said device and said function switch is depressed, further incrementing said silent time duration by said predetermined time duration;

inducing said second timer to count for a third time said second predetermined time period when said function switch is released after said silent time duration has been further incremented;

setting said radio pager to operate in said inaudible alert mode for said silent time duration which has been incremented by said device when said function switch remains released and said second timer, induced to count for a third time by device, finishes counting up said second predetermined time period.

16. A communication apparatus as claimed in claim 15, wherein said control device further performs the following functions:

setting said silent time duration to an unlimited time duration when said silent time duration, which has been incremented, exceeds a maximum allowable value;

inducing said second timer to count for a fourth time said second predetermined time period; and setting said radio pager to operate in said inaudible alert mode for an unlimited time period mode when said second timer, which has been induced by said device to count for a fourth time, finishes counting up said second predetermined time period, as long as said function switch remains released.

17. A communication apparatus as claimed in claim 16, wherein said control device further performs the following functions:

setting said silent time duration to a default value when said function switch is depressed and said second timer is counting for a fourth time;

inducing said second timer to count for a fifth time to said second predetermined time period when said function switch is released; and setting said radio pager to operate in said inaudible alert mode for said silent time duration which has been set when said function switch is depressed and said second timer is counting for a fourth time, when said function switch remains released and said second timer, induced by said device to count a fifth time, finishes counting up to said second predetermined time period.

18. A communication apparatus as claimed in claim 17, wherein said control device further performs the following functions:

incrementing said silent time duration by said predetermined time duration when said function switch is depressed when said second timer, induced to count for a fifth time, is counting said second predetermined time period;

setting said second timer to count for a sixth time said second predetermined time period when said function switch, which is depressed when said second timer induced to count for a fifth time is counting, is released; and setting said radio pager in said inaudible alert mode for said silent time duration, which has been incremented when said function switch is depressed when said second timer induced to count for a fifth time is counting, when said function switch remains released and said second timer, induced to count said sixth time, finishes counting up said second predetermined time period.

* * * * *